US007207464B2

(12) United States Patent
Brenner

(10) Patent No.: US 7,207,464 B2
(45) Date of Patent: Apr. 24, 2007

(54) EFFERVESCENT TABLET DISPENSER

(75) Inventor: Andreas Brenner, Ossingen (CH)

(73) Assignee: Createchic AG, Nurensdorf (CH)

( * ) Notice: Subject to any disclaimer, the term of this patent is extended or adjusted under 35 U.S.C. 154(b) by 93 days.

(21) Appl. No.: 10/511,923

(22) PCT Filed: Apr. 15, 2003

(86) PCT No.: PCT/CH03/00256

§ 371 (c)(1),
(2), (4) Date: Nov. 18, 2004

(87) PCT Pub. No.: WO03/086901

PCT Pub. Date: Oct. 23, 2003

(65) Prior Publication Data

US 2006/0049079 A1 Mar. 9, 2006

(30) Foreign Application Priority Data

Apr. 17, 2002 (CH) ..... 0647/02

(51) Int. Cl.
*B65G 59/00* (2006.01)
*B65H 3/30* (2006.01)
*G07F 11/16* (2006.01)

(52) U.S. Cl. ..... 221/295; 288/288; 288/247; 288/289; 288/312; 288/303; 288/312 R

(58) Field of Classification Search ..... 221/249, 221/248, 247, 289, 294, 303, 311, 288, 188, 221/185, 222, 297, 299, 312 R, 312 C, 295; 206/536

See application file for complete search history.

(56) References Cited

U.S. PATENT DOCUMENTS

| | | | | | |
|---|---|---|---|---|---|
| 2,255,449 | A | * | 9/1941 | Mutchler | 221/30 |
| 2,255,450 | A | * | 9/1941 | Mutchler | 221/30 |
| 2,519,438 | A | * | 8/1950 | Conley | 221/229 |
| 2,620,061 | A | * | 12/1952 | Uxa | 221/229 |
| 2,853,206 | A | * | 9/1958 | Uxa | 221/229 |
| 3,295,726 | A | | 1/1967 | Hanson | 222/109 |
| 3,300,090 | A | | 1/1967 | Carden | 221/281 |

(Continued)

FOREIGN PATENT DOCUMENTS

| | | | |
|---|---|---|---|
| DE | 9212939 U1 | * | 12/1992 |
| DE | G 92 12 939.0 | | 12/1992 |
| FR | 532723 | | 2/1922 |

(Continued)

*Primary Examiner*—Kathy Matecki
*Assistant Examiner*—Rakesh Kumar
(74) *Attorney, Agent, or Firm*—Edwin D. Schindler

(57) ABSTRACT

The effervescent tablet dispenser may be assembled onto the open end of a container tube (2). It consists of an annular lower part (3) which may be assembled onto the open end of a container tube (2). For this there is a lid (4) for closing the annular lower part (3). A dispenser tab (8) extends diametrically in a tongue-like manner in the lower part (3) in its clear opening This dispenser tab (8) is integrally formed on the inner edge (10) of the lower part (3) in the manner of a film hinge. With respect to the annular lower part (3) is may be pivoted out in the axial direction by at least 10°. When the container tube is tipped, the dispenser tab under the load of a tablet lying on it pivots approx. 10° downwards and the lowermost tablet may be easily removed with one hand, whilst the remaining ones are held back.

12 Claims, 6 Drawing Sheets

U.S. PATENT DOCUMENTS 3,565,284 A * 2/1971 Hinterreiter ..... 221/229
3,620,413 A 11/1971 Borsum ..... 221/289
3,622,041 A 11/1971 Borsum et al. ..... 221/202
3,861,563 A * 1/1975 Lisbin et al. ..... 221/279
4,171,753 A * 10/1979 Vreede ..... 221/197
4,311,251 A * 1/1982 Sternberg ..... 221/24
4,790,452 A * 12/1988 Pehr ..... 221/303
4,951,837 A * 8/1990 Lentsch ..... 221/45
5,071,033 A 12/1991 Siwek ..... 221/229
5,368,176 A * 11/1994 Thanisch ..... 215/235
5,368,191 A * 11/1994 Johnson ..... 221/194
5,560,516 A * 10/1996 Hinterreiter ..... 221/247
5,738,246 A * 4/1998 Chung ..... 221/222
5,769,253 A * 6/1998 Gross ..... 215/237
5,947,316 A * 9/1999 Guillonnet ..... 220/269
6,158,613 A * 12/2000 Novosel et al. ..... 221/3

* cited by examiner

EFFERVESCENT TABLET DISPENSER

BACKGROUND OF THE INVENTION

The invention relates to an effervescent tablet dispenser. Effervescent tablets are manufactured in a certain size, as a rule are disk-shaped with a diameter in the shape of about 30 mm and with a thickness of about 5 mm in order to specify the magnitude of size. The dispenser being introduced here however may also be designed for, and is suitable for tablets of other dimensions. Conventionally, such disk-shaped effervescent tablets are packaged and sold in aluminum tubes of about 10 cm length, which at one end comprise a base and whose open end is closed with a plastic closure after the filling. This plastic closure may be designed as a plug so that it therefore only needs to be pressed into the inside of the open tube. Other closures by way of a special outward formation of the tube edge and of the closure may clicked onto the edge of the tube or may be pushed over this in a manner such that they snap in. Closures which are designed cap-like with an inner thread in the cap and which may be screwed onto the open end of the tube by way of this thread are also conceivable. Often, the plastic closures on the inner side which is directed towards the tube comprise an elastic spiral which is integrally formed on the closure. If the tube has been filled with tablets by the manufacturer of the tablets, these tablets in the inside of the tube form a stack which however between its upper end and the lower side of the attached closure always leaves a small gap open In order to fill this or to compensate this and to prevent the tablets being thrown to and fro during transport and shipping on account of this gap and from becoming damaged, the end of the elastic spiral presses resiliently onto the upper end of the stack and holds this stack pressed together in a compact manner. A further closure is designed as a hinge closure. Its lower part is assembled onto the open end of the tube, and a pivotable lid (top) is integrally formed on this lower part via a film hinge, and this clicks onto the lower part when this is pivotally closed. For removing an individual tablet, one removes the closure lid or in the case of a closure with a pivotable lid one pivots the lid open and afterwards one tips the tube with one hand and holds its open end in the cup of the other hand. One often needs to shake the tube somewhat so that the tablets in the tube are detached and the stack slides outwards. However, then as a rule two or even more tablets roll into the cup made by the hand. One takes an individual tablet and must then place the excess tablets which have fallen out of the tube back into the tube again The removal of an individual tablet therefore has its problems and in all events has not been solved in a practical manner. In particular the individual separation has not been technically solved and in each case more tablets inadvertently fall from the tube than is indeed desired.

SUMMARY OF THE INVENTION

It is therefore the object of the present invention to provide an effervescent tablet dispenser which alleviates these problems and permits the secure and practical removal of an individual tablet.

This object is achieved by an effervescent tablet dispenser which may be assembled onto the open end of a container tube and wherein it consists of an annular lower part which may be assembled onto the open end of a container tube, as well as of an associated lid for closing this annular lower part, wherein in the lower part a dispenser tab extends in a tonguelike manner and diametrically into the clear opening of the lower part, wherein this dispenser tab is integrally formed on the inner edge of the lower part in the manner of a film hinge, so that with regard to the annular lower part it may be pivoted out in the axial direction by at least 10°.

BRIEF DESCRIPTION OF THE DRAWINGS

One advantageous embodiment of this effervescent tablet dispenser shown only by way of example is shown in various views in the drawings, and is described and its functioning is explained by way of these drawings.

There are shown in.

DETAILED DESCRIPTION OF THE INVENTION

Figure 1:
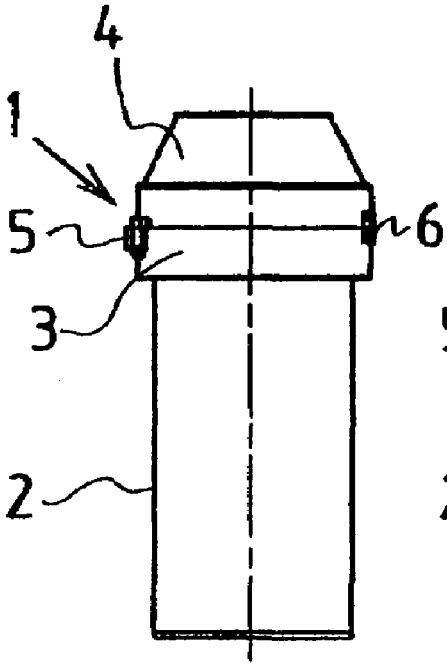
FIG. 1: the effervescent tablet dispenser in the closed condition, assembled onto a container tube, seen from the side, with the snap hinge belonging to the closure and the oppositely lying guarantee strip.
Figure 2:
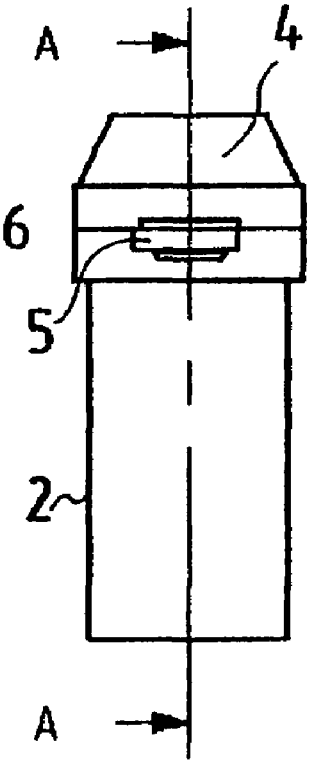
FIG. 2 the effervescent tablet dispenser in the closed condition, assembled on a container tube, rotated by 90° with respect to FIG. 1, in a view of the front side of the closure, with the guarantee strip.
Figure 3:
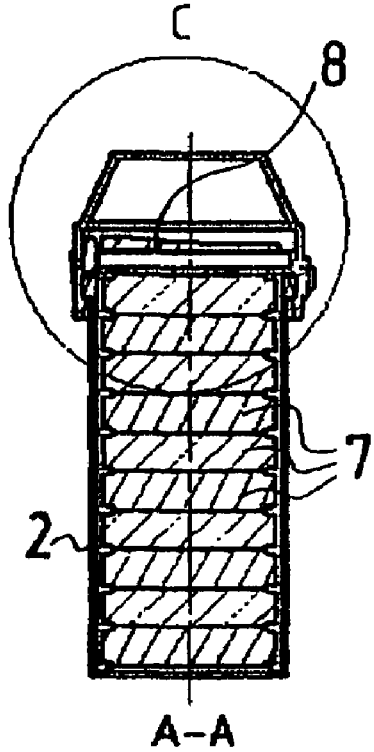
FIG. 3 the effervescent tablet dispenser in the closed condition, assembled on a container tube, in a section along the line A—A of FIG. 2.

In FIG. 1 one may firstly see the effervescent tablet dispenser 1 in the closed condition, assembled onto a container tube 2, seen from the side. At the right in the picture on this effervescent tablet dispenser designed as a closure 1 one may recognize a snap hinge 6 about which the lid 4 may be pivoted open upwards with respect to the lower part 3 of the closure 1. On the oppositely lying side, the closure is equipped with a guarantee strip 5. This must be tom away so that the lid 4 may be pivoted open for the first time. In FIG. 2 in the right next to this, one sees the same object rotated by 90° so that now the guarantee strip 5 lies at the front. The lid 4 here has the shape of a truncated cone, but may however also be shaped hemispherically or also in a different manner. FIG. 3 finally shows the same object in a longitudinal section along line A—A in FIG. 2. One recognizes the three tablets 7 stacked therein in the container tube 2. The cutout C in FIG. 3 is shown enlarged in FIG. 4. One recognizes that a dispenser tab 8 on the left side in the picture is integrally formed on the lower part 3 of the closure 1 via a small material bridge 9, and this dispenser tab is yet to be described in more detail. On the left on the closure one recognizes the snap hinge 6. One furthermore recognizes the inwardly projecting edge 13 on the lower side of the lower part 3 of the effervescent tablet dispenser 1, as well as the outwardly projecting edge 14 on the opening of the container tube 2. This effervescent tablet dispenser 1 which simultaneously forms a closure for the container tube 2, thanks to the shaping of its lower edge 13 may be pushed over the projecting edge 14 on the container tube 2 is a manner such that its snaps in, so that it is securely held thereon. For this, the effervescent tablet dispenser may be injected as one piece, but also of two different components. The lower part 3 may for example be manufactured of a softer material than the lid 4. A polyethylene for example is suitable for the lower part 3, whilst the film hinge 6 and the lid 4 are injected of a harder material such as polypropylene. The tube 2 may at the same time consist for example of a relatively hard polypropylene or of aluminum onto which the lower part 3 is then knocked or screwed. It is also conceivable for pushing the two parts, the lid 4 and the lower part 3 over one another, reversely for the lower part 3 for example to be manufactured of a harder material than the lid 4. Then for example a polypropylene is suitable for the lower part 3 whilst the film hinge 6 and the lid 4 are injected of a softer material such as polyethylene.

Figure 5:
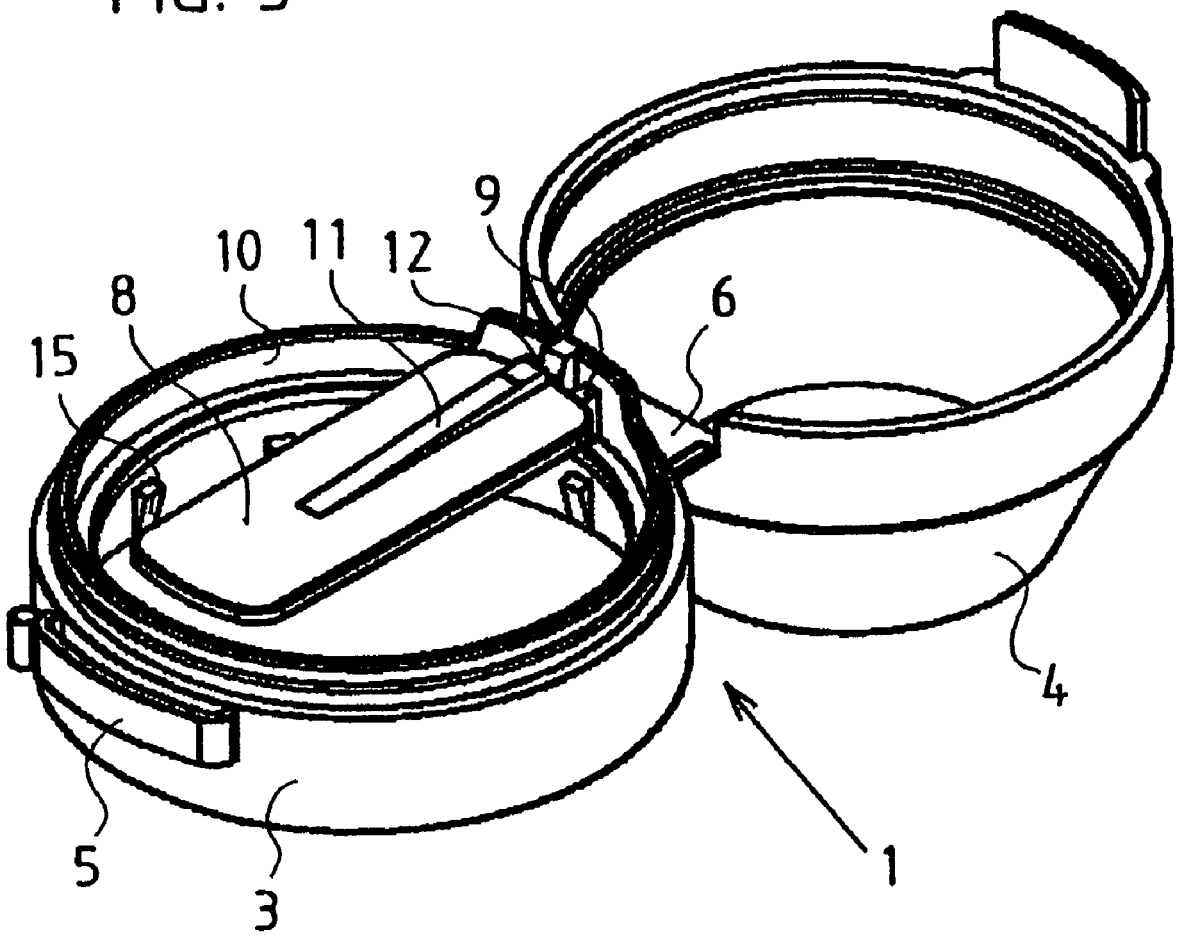
FIG. 5 the effervescent tablet dispenser without a container tube, with an opened lid, in a perspective view seen obliquely from the front.

The effervescent tablet dispenser 1 is shown in FIG. 5 in the opened condition in a perspective view seen from the front. At the rear side one may recognize the snapping film hinge 6 between the annular lower part 3 and the here truncated cone shaped lid 4 of the dispenser closure 1. The snap hinge 6 is designed according to the state of the art and in the closed condition pulls the lid 1 onto the closure lower part 3, whilst in the condition of being pivoted open it keeps it in this opened condition On the side lying opposite the snap hinge 6 one may recognize the guarantee strip 5. This effervescent tablet dispenser 1 according to the shown embodiment example then, as an essential feature, comprises a dispensing tab 8 extending in the lower part 3 of the closure 1 from the hinge side in a tonguelike and diametrical manner into the clear opening of the lower part. In the shown example this dispenser tab 8 is designed so long that it spans the complete clear width of the dispenser closer lower part 3. Its width is about ⅓ of the inner diameter of the closure lower part 3. It may however also be designed somewhat narrower and/or shorter, depending on the dimensions of the tablets to be dispensed. In one variant, the dispenser tab 8 may also be designed plate-like and fill out the complete clear width of the closure lower part 3. This dispenser tab 8 is integrally formed on the inner edge 10 of the lower part 3 via at least one film-hinge-like, thin material connection 9. In another embodiment, the tongue-shaped or plate-shaped dispenser tab may also be manufactured as a separate part and then be clipped onto the closure lower part 3 in that the tab has a hinge bolt integrally formed roughly on its rear side, which may be clicked into a hinge sleeve horizontally integrally formed on the closure lower part 3 which for this has a slot-like recess in the axial direction which permits the clicking-in of the associated hinge bolt Of course it is reversely also possible for the dispenser tab to carry the hinge sleeve which is open on one side and for the hinge bolt to be integrally formed on the closure lower part 3. In both cases thanks to this connection, the dispenser tab in the closure lower part 3 may be pivoted up and down. The hinges at the same time are designed such that the pivot range is limited, for example to approx 30°. For this, the outer side of the dispenser tab may have a reinforcement rib whose rear edge on pivoting the dispenser tab in the closure part 3 is abutted on this. The reason for limiting the pivot range will become evident later. In the shown example however, with regard to the parts which act as a hinge, it is the case of two material connections 9 via which the dispenser tab 8 is held on the lower part 3 in a manner which is stable with regard to the twisting about its longitudinal axis. These material connections 9 are designed so thinly that the dispenser tab 8 with respect to the annular lower part 3 of the closure 1 may be pivoted open by at least approximately 30°, that is to say, in the picture may be pivoted upwards. Furthermore the dispenser tab 8 shown here, on its upper side and running along its middle comprises a rib 11 which tapers into a tip towards the front end of the tab 9 in a wedge-like manner. This rib 11 reinforces the dispenser tab 8 and renders it stiff On its rear side 12, this rib 11 with its rearward edge forms an abutment. If specifically the dispenser tab 8 is pivoted upwards about its film-hinge like root connection 9, the vertical rear edge 12 of the rib 11 pivots to the rear and finally abuts on the inner edge 10 of the dispenser closure lower part 3. By way of this, the extent of the pivoting-out of the dispenser tab 8 is limited. This function is significant as will be described later.

Figure 6:
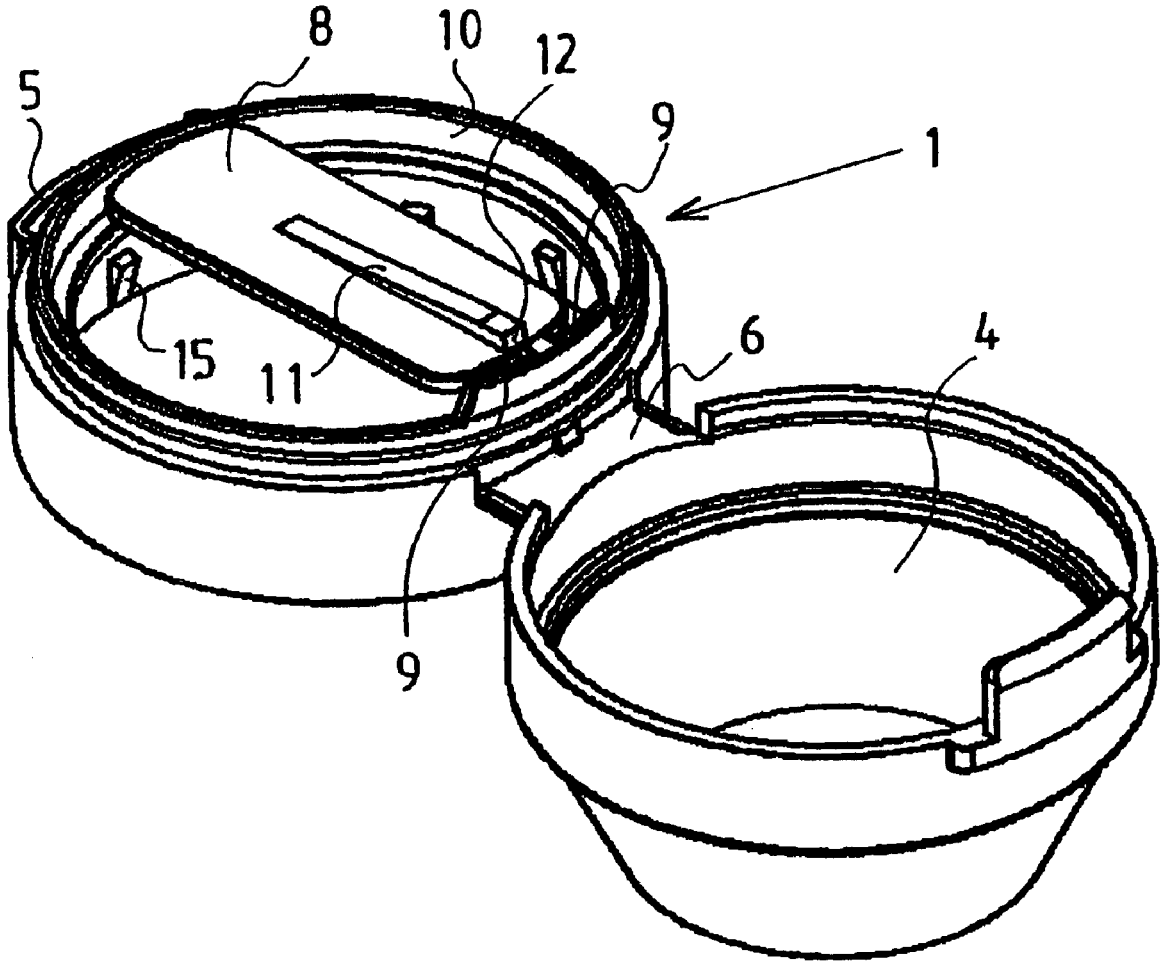
FIG. 6: the effervescent tablet dispenser without a container tube, with an opened lid, in a perspective view seen obliquely from the rear.

FIG. 6 shows the effervescent tablet dispenser 1 in a perspective view obliquely from the rear. Here one may recognize the material bridges 9 as well as the rear edge 12 of the rib 11 which forms an abutment which abuts on the inner edge 10 of the lower part 3 on pivoting open the dispenser tab 8 and thus limits the pivoting movement. Small wedge-like guide elements 15 are integrally formed around the inner periphery of the lower part 3. These center the tablets which in the picture move through the effervescent tablet dispenser from the bottom to the top, as will become evident later.

Figure 7:
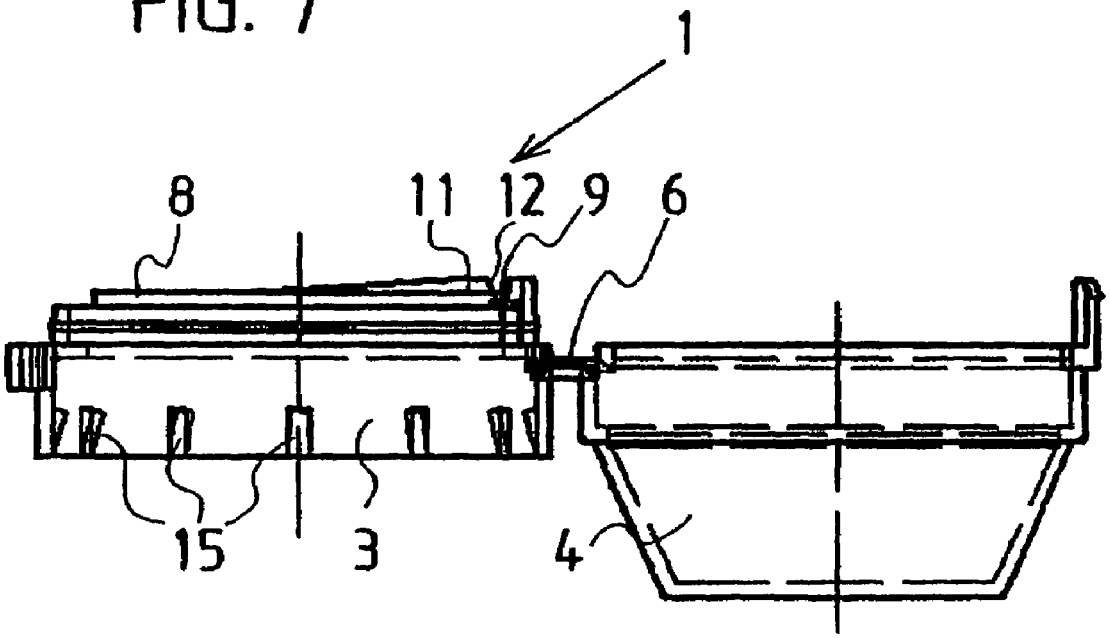
FIG. 7: the effervescent tablet dispenser without a container tube with an opened lid, seen a view from the side.
Figure 8:
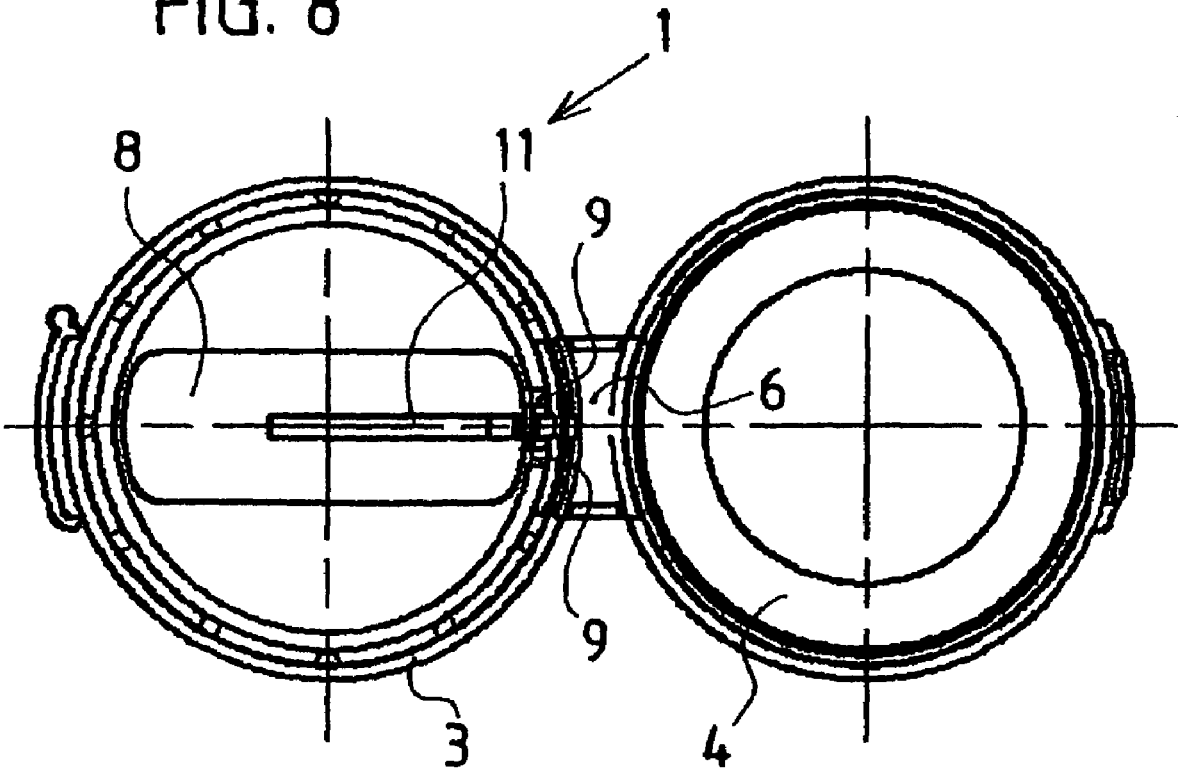
FIG. 8: the effervescent tablet dispenser without a container tube with an opened lid, in a view seen from above.

In FIG. 7 one may recognize the effervescent tablet closure in the opened condition seen from the side, in a section through its longitudinal center. One recognizes the lower part 3 with the lid 4 pivoted open by 180°. One may further recognize the dispenser tab 8 which runs flush with the upper edge of the lower part 3 of the closure, as well as a material bridge 9 and the reinforcement rib 11 with its rear edge 12 which abuts on the slightly raised inner edge 10 on pivoting open the dispenser tab. One may furthermore see a number of guide elements 15 which serve for centering the tablets. In FIG. 8 the closure or effervescent tablet dispenser 1 is shown in the opened condition in a plan view. As one recognizes, the dispenser tab 8 extends over the whole clear diameter of the lower part and its width measures approx. ⅓ of this diameter. One recognizes the two material bridges 9 and the rib 11 which serves for stiffening the dispenser tab 8.

Figure 9:
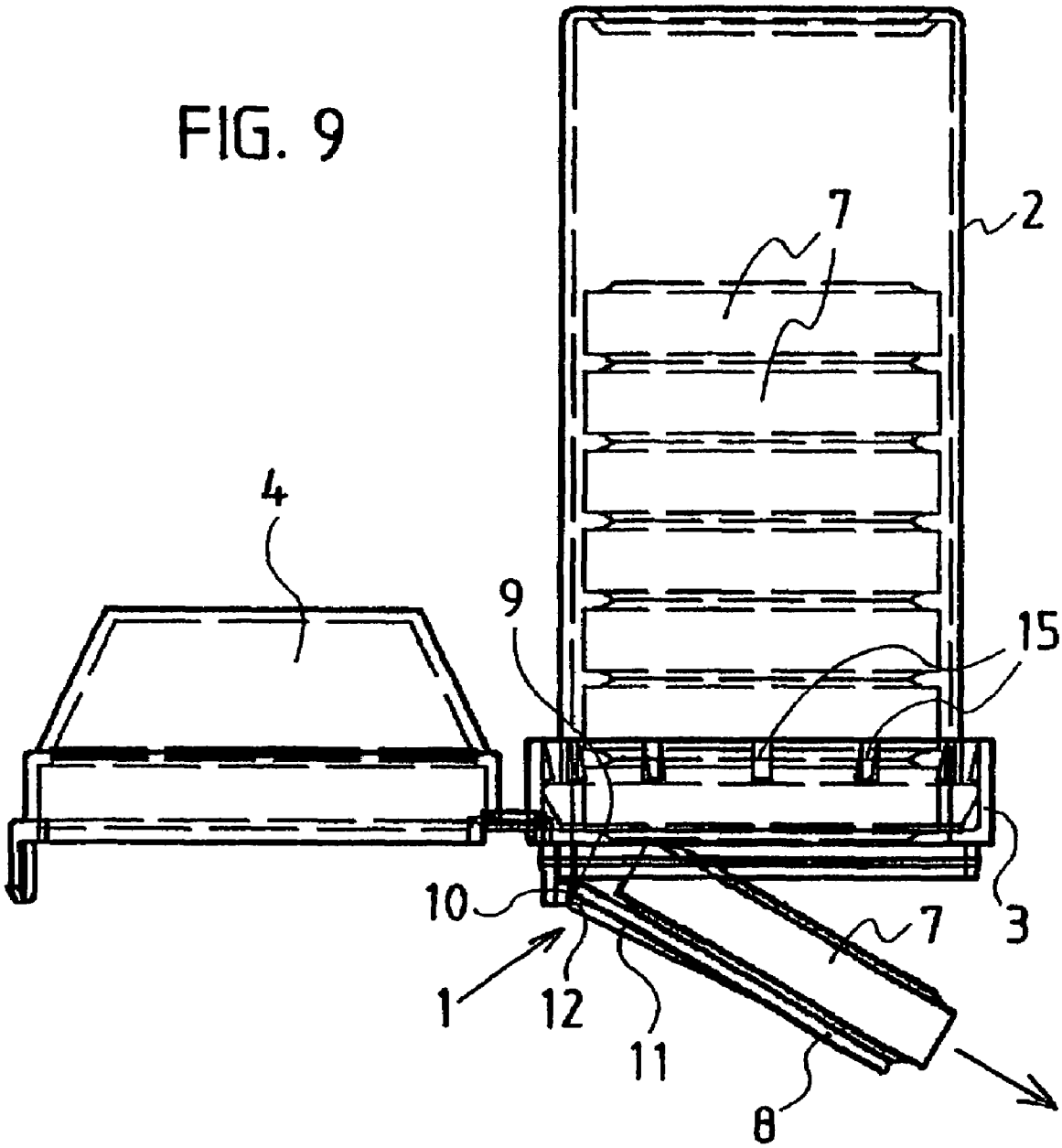
FIG. 9: the effervescent tablet dispenser assembled on a container tube, here in the tipped position of the container tube, with an opened lid, seen in a view from the side, partly in section, with a dispensed tablet.

FIG. 9 shows a container tube 2 filled with tablets 7 in the tipped condition, with an effervescent tablet dispenser 1 assembled on its open side, with a pivoted-open lid 4, thus in the opened condition The tablet stack 7 located in the container tube 2 with its weight presses on the dispenser tab 8. Under the load of this weight, the dispenser tab 8 pivots downward until the rear side 12 of the rib 11 abuts on the inner edge 10 of the closure lower part 3. Then the pivot position of the tab 8 which is shown here is assumed. The tablet 7 which is at the very bottom in the shown representation then lies at the bottom on the stack, but is pivoted by 30° downwards with respect to the tablets lying above it, which still lie snugly in the inside of the container tube, since the somewhat broader inner diameter of the annular closure lower part 3 below the guide elements 15 permits this pivoting of the lowermost tablet 7 lying on the dispenser tab 8. Furthermore, on falling through the closure lower part 3 it is centered by the guide elements 15 which are integrally formed all around. In the slightly pivoted down condition, this tablet 7 may be easily grasped with the thumb and index or middle finger of a hand and may be taken out along the dispenser tab 8 in the direction of the drawn arrow. As soon as the tablet has been taken out in the direction of the arrow, the dispenser tab 8 catches the subsequent tablet which one however no longer removes but pushes it back into the container tube 2 by way of pivoting back the dispenser tab 8 by way of a slight pressure on its upper side, by which means the lid 4 may be closed. The material bridges 9 via which the dispenser tab 8 is integrally formed on the closure lower part 3 are designed so thinly and weakly that they also are pivoted downwards under the weight of only a single tablet 7 contained in the container tube 2. On the other hand however the material bridges 9 are so strong that they do not break under the load of the whole stack, thus when the container tube 2 is still completely filled. Rather then the abutment 12 formed by the rear edge 12 of the rib 11 ensures that the dispenser tab 8 is not pivoted too greatly downwards and thus it is ensured that in each case only a single tablet is dispensed for removal. Thus by way of the thin material bridges 9 and the abutment 12, it is ensured that the dispenser tab 8 is always pivoted downwards reliably to the same degree irrespective of how many tablets 7 are loaded on it when the container tube is tipped.

Figure 10:
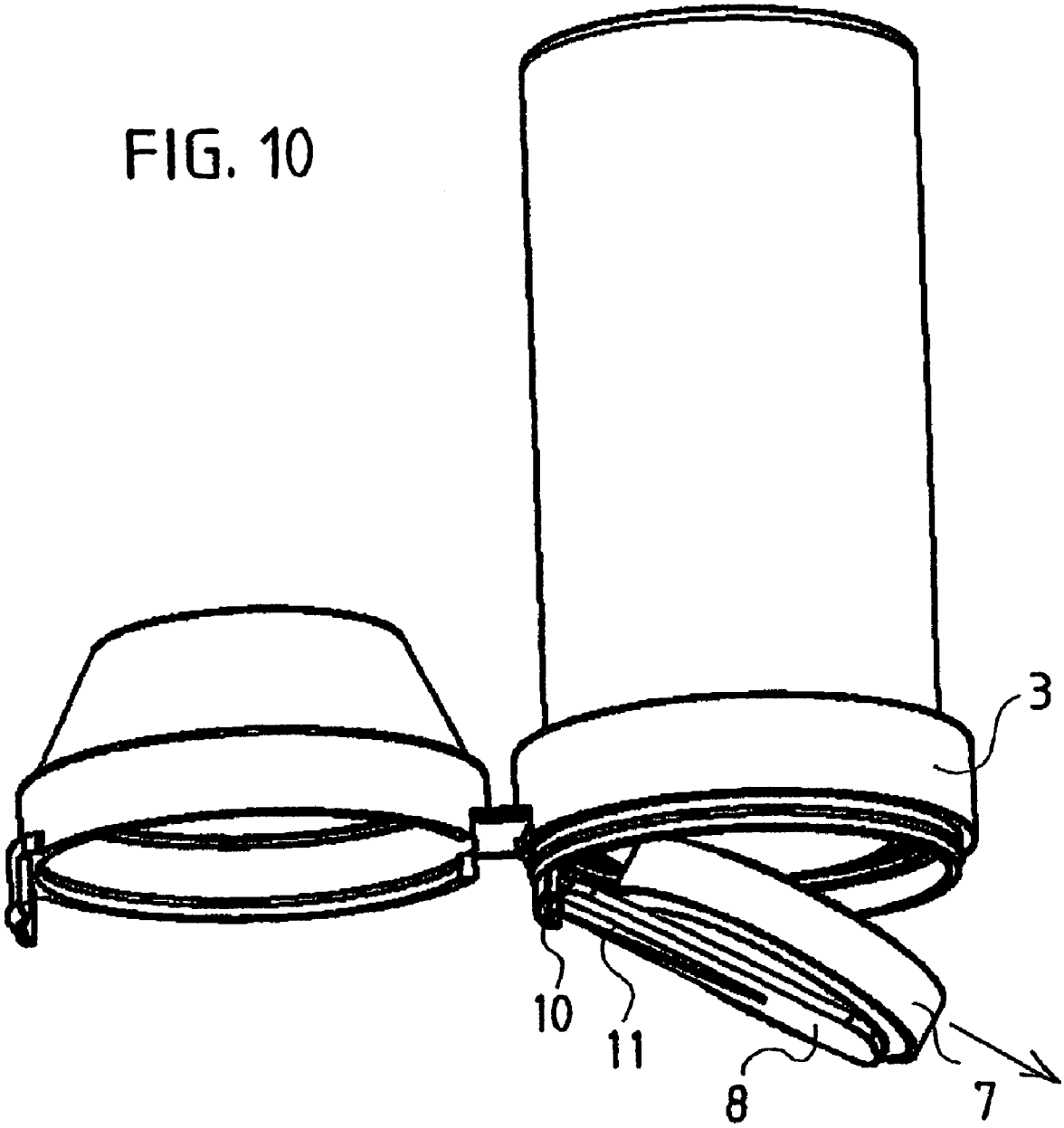
FIG. 10: the effervescent tablet dispenser assembled on a container tube, here in the tipped position of the container tube, with an opened lid, seen in a perspective view obliquely from below, with a dispensed tablet.

Finally in FIG. 10, the same situation as in FIG. 9 is shown, but in a perspective view obliquely from below. The inner edge of the lower part 3 is slightly raised in the region of the material bridges 9 of the dispenser tab 8 so that the rear edge of the rib 11 is abutted thereon. In place of two material bridges it may also be the case of only a single one which then extends over a part of the rear broad side of the dispenser tab or even over its whole width As already mentioned, the dispenser tab may also be designed in a pivotable manner in that it is designed as a separate part and then via a hinge is fastened to a bolt or sleeve on the lower part of the closure. However the hinge then does not form any restoring force and the dispenser tab must be pushed back each time into the original position with the finger. Furthermore the hinge should be so easily overcome that a single tablet is still able to pivot the dispenser tab downwards. If the hinge is not so easy-running then on the outer side of the dispenser tab one may integrally form a grip for example in the shape of a small hump. Then one may then grip the dispenser tab there and actively pivot it downwards so that an individual tablet is dispensed.

Figure 4:
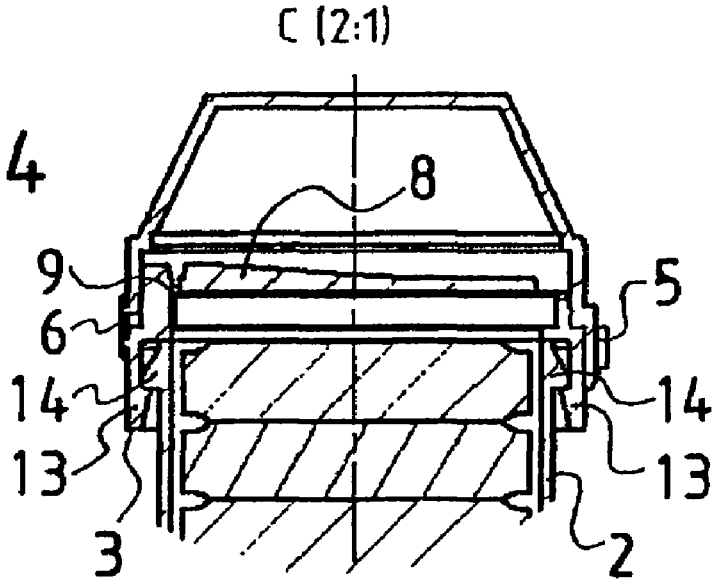
FIG. 4 the effervescent tablet dispenser in the cutout C according to FIG. 3, in an enlarged representation.

It is clear that such a dispenser closure for effervescent tablets may also be designed as a threaded closure in that the closure lower part 3 comprises a thread on its outer side and the associated lid 4 comprises an inner thread which fits with this. The seam location between the closure lower part 3 and the lid 4 may in this case be provided with a peripheral guarantee strip. The closure lower part 3 may be fastened on the container tube 2 in various manners. This may be by way of an inner thread which fits onto a corresponding thread on the container tube 2. Or the closure lower part 3 on its lower edge is provided with an edge which projects slightly inwards and which via a slight projection 14 fits on the outer edge of the container tube opening, as this is shown in FIG. 4.

The invention claimed is:

1. An effervescent tablet dispenser assemblable onto an open end of a container tube, said effervescent tablet dispenser, comprising:

an annular lower part capable of being assembled onto an open end of a container tube;

a dispenser tab in said annular lower part, said dispenser tab extending diametrically into a clear opening of said lower annular part with said dispenser tab being integrally formed on an inner edge of said annular lower part in a hinged manner, via a film-hinge material bridge extending over at least a portion of a width of said dispenser tab, for being pivotable outwardly in an axial direction relative to said annular lower part, said dispenser tab further comprising at least one rib standing vertically on said dispenser tab for reinforcing said dispenser tab and with a rear edge of said at least one rib, upon pivoting open in said annular lower part, forming an abutment at said inner edge of said annular lower part for limiting pivotal movement; and, a lid for closing said annular lower part.

2. The effervescent tablet dispenser assemblable onto an open end of a container tube according to claim 1, wherein said annular lower part is made of a harder material than a material of which said lid is made.

3. The effervescent tablet dispenser assemblable onto an open end of a container tube according to claim 1, wherein said lid is made of a harder material than a material of which said lower annular part is made.

4. The effervescent tablet dispenser assemblable onto an open end of a container tube according to claim 1, wherein said dispenser tab in said annular lower part diametrically extends in a tongue-like manner in the clear opening of said annular lower part, said dispenser tab being pivotable outwardly in the axial direction by at least 10°.

5. The effervescent tablet dispenser assemblable onto an open end of a container tube according to claim 1, wherein said dispenser tab extends diametrically in the clear opening of said annular lower part in a plate-like, or tongue-like, manner, wherein said dispenser tab via a hinge of a bolt and sleeve is clickable onto said inner edge of said annular lower part, so that, relative to said lower annular part, said dispenser tab is pivotable outwardly in the axial direction by at least 10°.

6. The effervescent tablet dispenser assemblable onto an open end of a container tube according to claim 1, wherein said dispenser tab has a width of ⅓ of an inner diameter of said annular lower part and with a length of said dispenser tab extending entirely over the inner diameter of said annular lower part.

7. The effervescent tablet dispenser assemblable onto an open end of a container tube according to claim 1, wherein said dispenser tab has an end that is integrally formed on said inner edge of said annular lower part via two film-hinge material bridges distanced from one another, so that said dispenser tab is integrally formed in a twist-stable manner about a longitudinal axis of said dispenser tab.

8. The effervescent tablet dispenser assemblable onto an open end of a container tube according to claim 1, further comprising guide elements for centering a tablet falling through said annular lower part being integrally formed and distributed around a periphery of an inner wall of said annular lower part.

9. The effervescent tablet dispenser assemblable onto an open end of a container tube according to claim 1, wherein said annular lower part includes an inner thread for permitting said annular lower part to be screwed onto the open end of a container tube.

10. The effervescent tablet dispenser assemblable onto an open end of a container tube according to claim 1, wherein said annular lower part includes an inwardly projecting edge, so that said lower annular part is able to be pushed over a container tube with an outwardly projecting bead in a click-in manner.

11. The effervescent tablet dispenser assemblable onto an open end of a container tube according to claim 1, wherein said lid is connected to said annular lower part via a film-hinge snap hinge.

12. The effervescent tablet dispenser assemblable onto an open end of a container tube according to claim 1, wherein said lid is a threaded lid having an inner thread that is screwable onto a fitting outer thread on said annular lower part.

* * * * *